United States Patent [19]

Thiesler et al.

[11] 4,091,750

[45] May 30, 1978

[54] GRATE PLATE ARRANGEMENT FOR A TRAVELLING GRATE

[75] Inventors: Ingo Thiesler; Max Weiner, both of Neubeckum; Karl Steffens, Hamm, all of Germany

[73] Assignee: Polysius AG, Neubeckum, Germany

[21] Appl. No.: 763,692

[22] Filed: Jan. 28, 1977

[30] Foreign Application Priority Data

Mar. 13, 1976 Germany ..... 2610736

[51] Int. Cl.[2] ..... F23B 1/22

[52] U.S. Cl. ..... 110/329; 266/178; 432/137

[58] Field of Search ..... 266/178, 180, 279; 432/137; 110/40 R, 40 A

[56] References Cited

U.S. PATENT DOCUMENTS

| | | | |
|---|---|---|---|
| 1,122,204 | 12/1914 | Holt | 110/40 A |
| 1,963,789 | 6/1934 | Holt | 110/40 R |
| 3,322,414 | 5/1967 | Boron | 166/178 |
| 3,925,907 | 12/1975 | Heinemann | 266/178 |
| 3,980,425 | 9/1976 | Pinettes et al. | 110/40 R |

*Primary Examiner*—Kenneth W. Sprague
*Attorney, Agent, or Firm*—Jones, Thomas & Askew

[57] ABSTRACT

The invention relates to a grate plate arrangement for a travelling grate in which the grate plates bear with their front highly curved portion on a grate pin and with their rear less curved portion on the following grate plate, a web provided at the lower side of each grate plate being connected to a three-armed holder which engages beneath said grate pin and the following grate pin and thus prevents the grate plate pivoting up.

6 Claims, 8 Drawing Figures

GRATE PLATE ARRANGEMENT FOR A TRAVELLING GRATE

BACKGROUND OF THE INVENTION

With the aid of FIGS. 1 and 2 a known grate plate arrangement will first be explained. FIG. 1 is a partial view of a plate arrangement from below and FIG. 2 a section along the line II—II of FIG. 1.

The known plate arrangement for a travelling grate illustrated in FIGS. 1 and 2 comprises plates 1, 1', 1'', etc. which bear with their front highly curved portion 2 on a pin 3 (with interposed spacer tube 4) and with their real less curved portion 5 on the following plate (e.g. 1').

The plates are provided with a plurality of through slots 6 which extend in the longitudinal direction of the plate and serve for the passage of gaseous treatment medium (hot gases or cooling air).

To increase the strength each plate is provided at its lower side with two longitudinally extending lateral webs 7, 8 and with a cross web 9 disposed substantially in the centre of the plate. Further reinforcing webs running in the longitudinal direction are denoted by 10 and 11.

To secure the plate 1 in its position on the pin 3 and prevent a pivoting up of the plate (in the clockwise direction in FIG. 2, for instance by increased air pressure or in the lower run of the grate) a holder is provided which consists of substantially three arms 12, 13 and 14. The arms 12 and 13 are secured by means of screws 15, 16 and the arm 14 by means of a screw 17 to the cross web 9. The arms 12 and 13 engage beneath the pin 3 and the arm 14 beneath the following pin 3'. The forwardly directed arms 12 and 13 are laterally offset with respect to the rearwardly directed arm 14 so that between the arms 12 and 13 there is room for the arm 14'' of the preceding plate 1''.

This known grate plate arrangement has certain disadvantages.

Due to the considerable length between the engagement point of the arm 14 on the following pin 3' (or the spacer tube 4') and the mounting of this arm 14 (screw 17) there is a great leverage which leads to high stress of the mounting point. The screw 17 is subjected both to tension and the shearing stress. If the mounting screw 17 becomes loose during operation under this high stress the plate 1 can partially pivot resulting in an undesirable dropping through of material.

Another constructional disadvantage is that the cross web 9 to which the arm 14 is secured is subjected to bending stress. Finally, another disadvantage is that due to the large number of individual parts and the necessary tightening of several screw connections the assembly of the plates and their holding arms is exceedingly time-consuming and complicated.

SUMMARY OF THE INVENTION

The invention is thus based on the problem of avoiding the defects referred to of the known construction and developing a grate plate arrangement which is distinguished by a substantially simplified assembly and an improved operational reliability.

This problem is solved according to the invention in that the integrally formed three-armed holder is positively connected to the front portion of the grate plate and in the rear half of its length is screwed to a longitudinal web of the grate plate.

With such an arrangement there is a relatively short leverage between the force engagement point of the rearwardly directed arm of the holder and the mounting point of the holder. The connecting element provided between the holder and the longitudinal web of the grate plate is not stressed flexurally in the plate arrangement according to the invention but subjected to only sheer stress; it is further advantageous that the longitudinal web of the plate carrying the holder is only tensilely stressed.

If for some reason with the arrangement according to the invention the connection between the holder and the longitudinal web of the plate becomes loose this does not initially result in any appreciable change of the vertical position between holder and plate.

Furthermore, due to the reduction of the number of individual parts and the mounting points the assembly is considerably simplified and this also reduces the shutdown times of the travelling grate which occur when it is necessary to replace individual plates.

Expedient further developments of the invention are the subject of the subsidiary claims and will be explained in detail with the aid of the description of two examples of embodiment. In the drawings:

DETAILED DESCRIPTION

Figure 1:
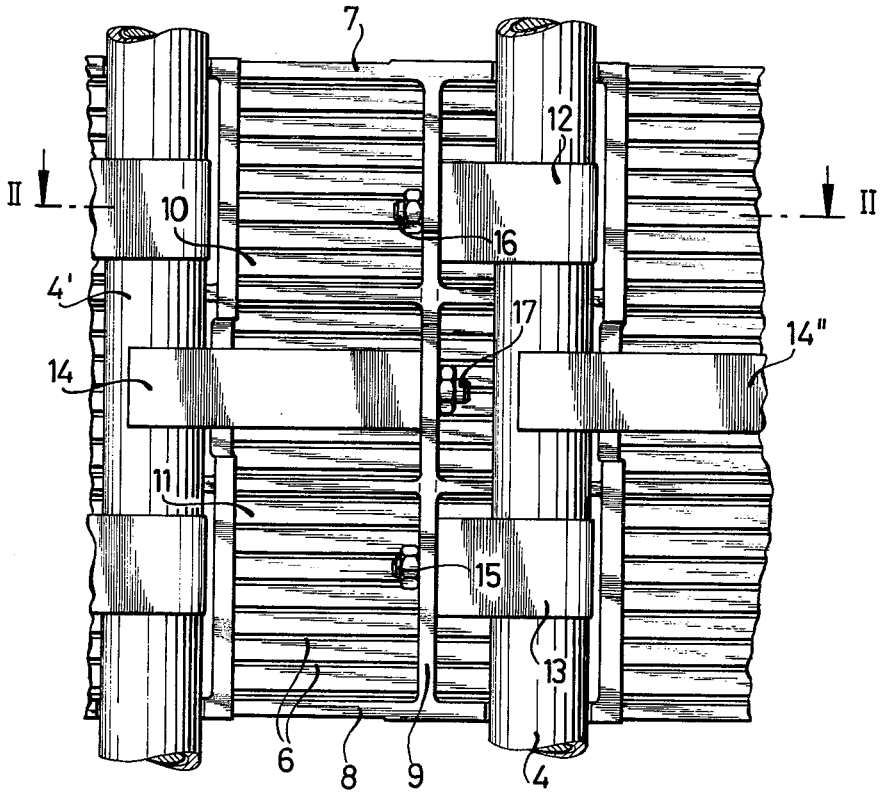
FIGS. 1 and 2 show a partial view and section of the known plate arrangement already explained.
Figure 2:
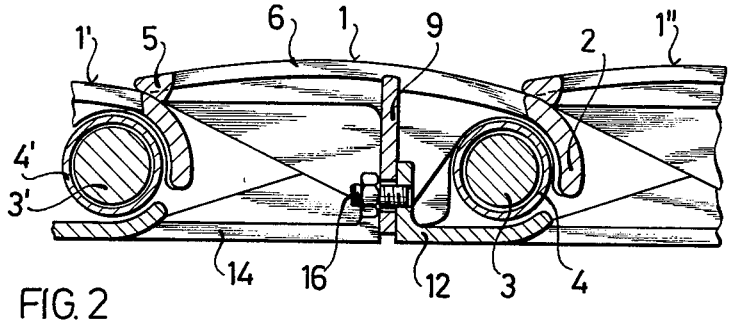

The grate plate 21 according to the invention bears as in the already explained known embodiment with its front highly curved portion 22 on the pin 3 or spacer tube 4 whilst the rear less curved portion 25 bears on the following plate 21'.

Provided at the lower side of the plate 21 are longitudinally extending lateral webs 27, 28 which have in the front portion semicircular recesses for bearing on the spacer tube 4.

Furthermore, at the lower side of the plate 21 somewhat behind the centre portion of the plate length a cross web 29 is provided followed rearwardly by a longitudinal web 30 which is provided with a downwardly directed extension 30a with an opening therein constructed as an eye.

The plate 21 is secured in its position by an integrally formed holder 31 which comprises two downwardly directed arms 32, 33 and a rearwardly directed arm 34.

Figure 3:
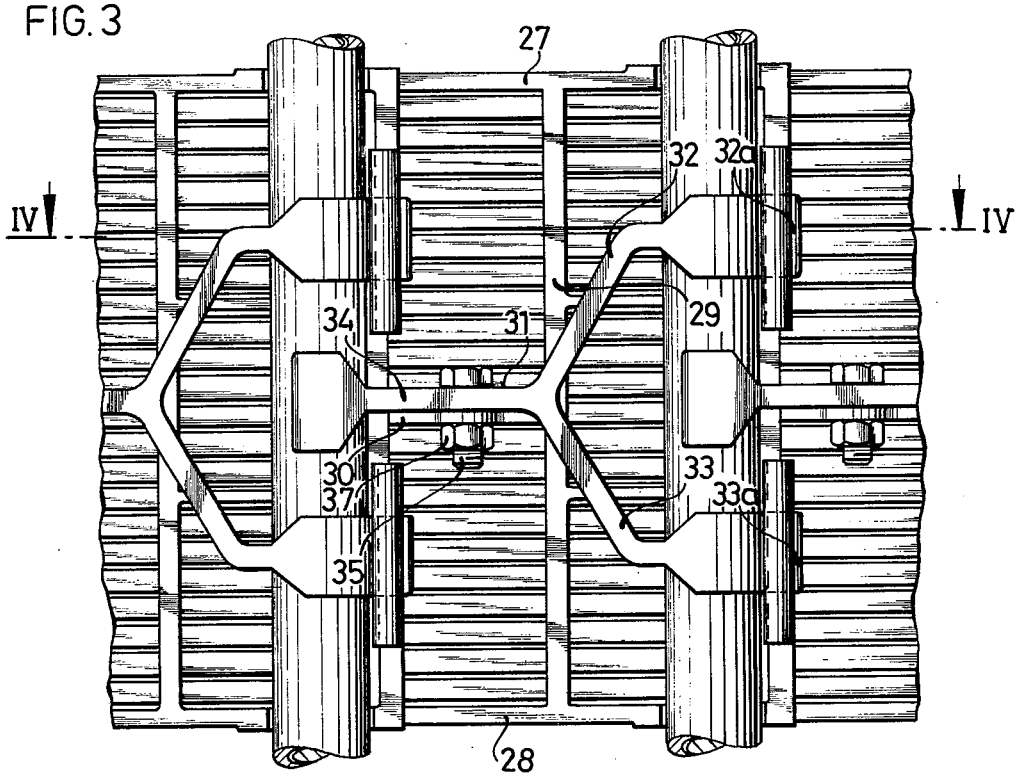
FIG. 3 shows a view of a plate arrangement according to the invention from below.
Figure 4:
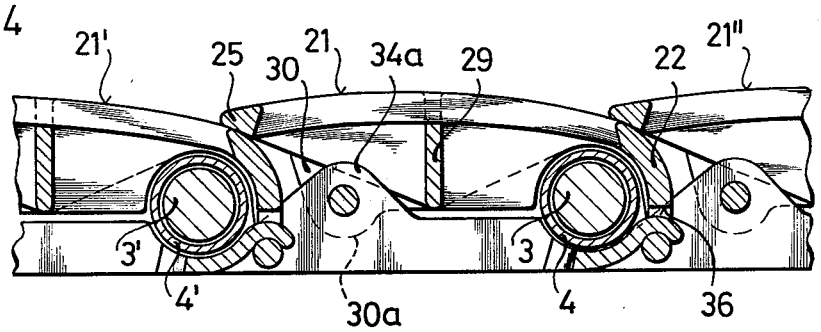
FIG. 4 shows a section along the line IV—IV of FIG. 3.
Figure 5:
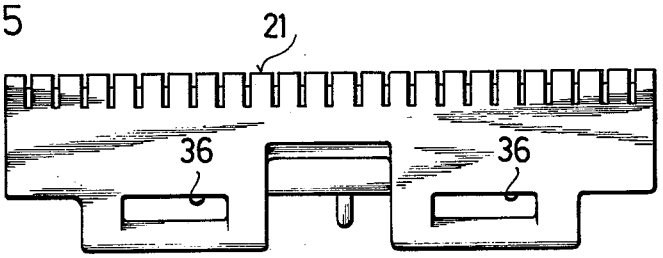
FIG. 5 is an elevation of the plate according to the invention from the front.
Figure 6:
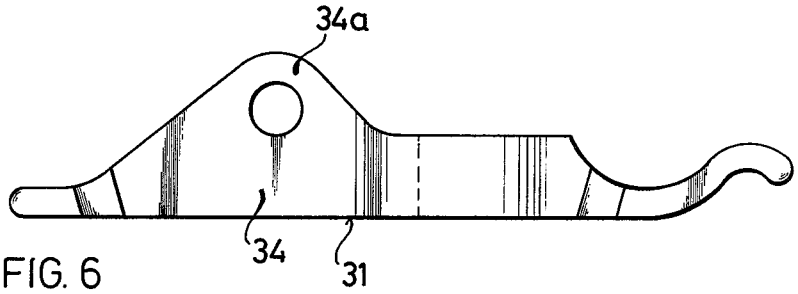
FIGS. 6 and 7 show a side view and plan view of a holder.
Figure 7:
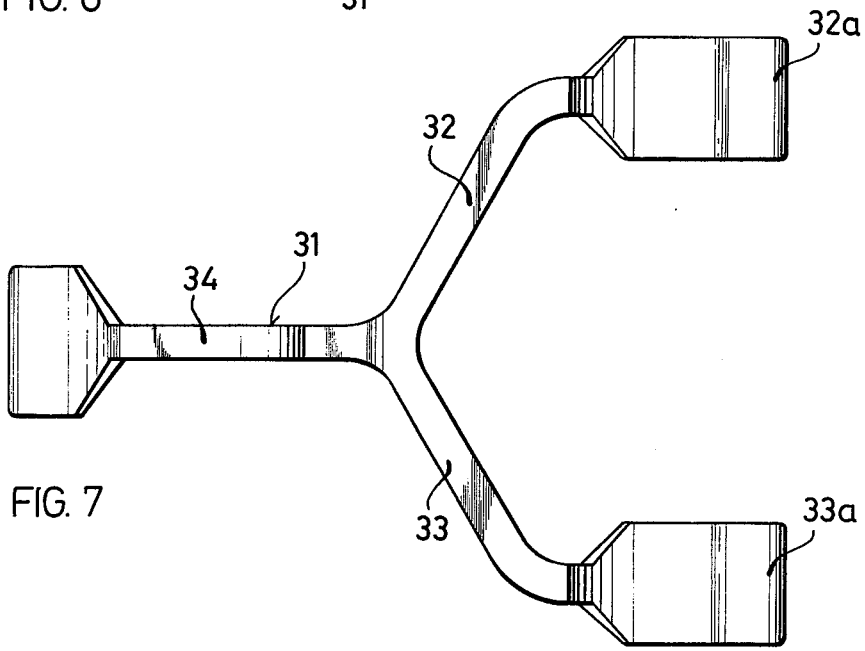

As particularly apparent from FIGS. 3 and 7, this three-armed holder 31 is made fork-like, the two forwardly directed arms adjoining the rearwardly directed arm 34 symmetrically at an angle greater than 90°, preferably at an angle between 110 to 140°.

The rearwardly directed arm 34 is provided with an upwardly directed extension 34*a* constructed as an eye opening which is connected to the aforementioned extension 30*a* of the longitudinal web 30 of the plate by a screw 35. This connection point between the holder 31 and the plate 21 thus lies in the rear half of the plate length so that there is a relatively short leverage between the force engagement point (on the spacer tube 4') and the mounting point (screw 35).

In the example of embodiment illustrated in FIGS. 3 to 7 the front portion 22 of the plate 21 is drawn downwardly relatively deeply and provided with two slot-like openings 36 into which the two arms 32, 33 of the holder engage positively. The ends **32*a*, 33*a* of the arms 32, 33 are curved for this purpose in the manner shown in FIGS. 4 and 6**.

The assembly of the grate plate arrangement according to the invention should be readily clear:

The integral holder 31 is inserted from below with its two forwardly directed arms 32, 33 into the slot-like openings 36 of the plate 21 and pivoted upwardly. The two front arms 32, 33 of the holder 31 engage round the spacer tube 4 of the pin 3. At the same time, the extension **34*a* of the arm 34 of the holder 31 moves adjacent the extension 30*a* of the web 30 of the plate until the bores in said two extensions coincide. The screw 35 can now be introduced and tightened with the nut 37**.

Figure 8:
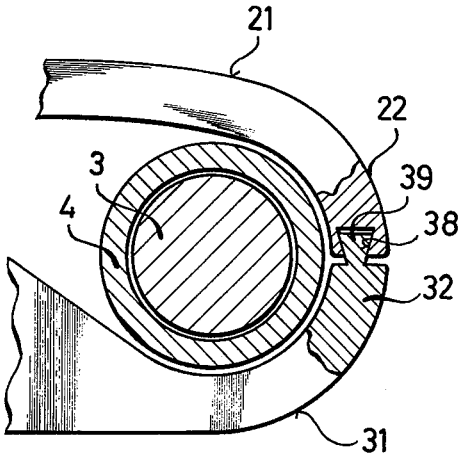
FIG. 8 is a partial section through another example of embodiment of the invention.

FIG. 8 shows another modification of the positive connection between the front portion 22 of the plate 21 and the arms 32, 33 of the holder 31. The front portion 22 of the plate 21 comprises a dove-tail guide 38 into which may be inserted the two arms 32, 33 of the holder 31 with a complementary profile 39 in the transverse direction.

We claim:

1. A grate plate assembly for a travelling grate comprising a plurality of approximately equally spaced parallel pin members movable in sequence along a path normal to their lengths, a plurality of grate plates each spanning adjacent pairs of said pin members and each including a forward portion bearing on a pin member and a rear portion bearing on the next adjacent following grate plate, and a web extending from each of said grate plates into the space between the adjacent pin members, a unitary grate plate holder for each grate plate with each said holder comprising a pair of arms extending beneath the pin member on which the grate plate bears and connected to the forward portion of its grate plate in front of the pin member and a rearwardly directed arm extending beneath the next adjacent following pin member and a web extending into the space between the adjacent pin members in overlapping relationship with the web of said great plate, openings formed in the webs of said great plate and said grate plate holder, and fastening means extending through said holes.

2. The grate plate assembly according to claim 1, characterized in that said holder is made fork-like and said pair of arms adjoin the rearwardly directed arm symmetrically at an angle greater than 90°, preferably at an angle between 110° and 140°.

3. The grate plate arrangement according to claim 1, characterized in that the forward portion of said great plate is provided with two slot-like openings for engagement by said pair of arms of said holder.

4. The grate plate assembly according to claim 1, characterized in that the forward portion of said plate includes dove-tail guides into which the arms of the holder with complementary profile are insertable.

5. In a travelling grate assembly including a series of approximately equally spaced parallel pin members movable in sequence in a forward direction extending across their lengths and a plurality of grate plates each including a front portion bearing on one of said pin members and a rear portion bearing on the following adjacent grate plate, the improvement comprising a unitary grate plate holder for each of said great plates including forwardly directed arms extending on the side of the forward pin member opposite to the front portion of its grate plate and connected to the front portion of its grate plate in front of the forward pin member, and a rearwardly directed arm extending on the side of its rear pin member opposite to its grate plate, and connecting means connecting each of said grate plate holders to a central portion of its grate plate between adjacent pin members.

6. The invention according to claim 5 and wherein said connecting means comprises each grate plate including a connector extension adjacent its rear portion, and each grate plate holder including a connector extension adjacent its rear portion in overlapping relationship with the connector extension of said grate plate, aligned openings formed in said grate plate connector extension and in said grate plate holder connector extension, and a connector member extending through said aligned openings.

* * * * *